US007168124B2

(12) United States Patent
Dalias

(10) Patent No.: US 7,168,124 B2
(45) Date of Patent: Jan. 30, 2007

(54) GRILL BRUSH AND GRILL CLEANING SYSTEM

(76) Inventor: Robert J. Dalias, 7 Copper Beech Rd., Salem, NH (US) 03079

( * ) Notice: Subject to any disclaimer, the term of this patent is extended or adjusted under 35 U.S.C. 154(b) by 113 days.

(21) Appl. No.: 10/855,920

(22) Filed: May 27, 2004

(65) Prior Publication Data

US 2005/0086755 A1 Apr. 28, 2005

Related U.S. Application Data

(63) Continuation-in-part of application No. 10/692,341, filed on Oct. 23, 2003.

(51) Int. Cl.
*A46B 9/02* (2006.01)
*A46B 1/00* (2006.01)

(52) U.S. Cl. ..... 15/160; 15/207.2; 15/DIG. 5; 15/DIG. 6; 15/197

(58) Field of Classification Search ..... 15/159.1, 15/160, 207.2, DIG. 5, DIG. 6, 190, 195, 15/197
See application file for complete search history.

(56) References Cited

U.S. PATENT DOCUMENTS 1,878,323 A * 9/1932 Quist ..... 15/197
2,043,758 A * 6/1936 Lay ..... 15/159.1
3,072,940 A * 1/1963 Kelly ..... 15/52.1
3,505,163 A * 4/1970 Meers et al. ..... 428/371
4,286,349 A * 9/1981 Dugrenier ..... 15/111
5,373,600 A * 12/1994 Stojanovski et al. ..... 15/111
6,772,466 B2 * 8/2004 Ziegler ..... 15/160
2004/0019991 A1 * 2/2004 Neal et al. ..... 15/111
2005/0160544 A1 * 7/2005 Geller ..... 15/160

* cited by examiner

*Primary Examiner*—Gladys J P Corcoran
*Assistant Examiner*—Laura C Guidotti
(74) *Attorney, Agent, or Firm*—Weingarten, Schurgin, Gagnebin & Lebovici LLP

(57) ABSTRACT

An improved grill brush for cleaning grill grates and a cleaning system including a grill grate specifically adapted for use with the disclosed grill brush includes a head portion and a handle portion. A plurality of metallic bristles is mounted to and extends from at least one surface of the head. Some of the bristles are made of a first metal and others of the bristles are made of a second metal. In one embodiment, one metal is stiffer than the other metal, the stiffer bristles are shorter than the more flexible bristles, and the bristles are arranged so as to form rows of short, stiff bristles parallel to rows of long, flexible bristles. In this embodiment, the length and configuration of the bristles is generally specified for the grill grate with which the brush is intended to be used to facilitate cleaning the top and side portions of the grill grate. In another embodiment, the bristles are fabricated of at least two different materials and are of the same length.

6 Claims, 6 Drawing Sheets

GRILL BRUSH AND GRILL CLEANING SYSTEM

CROSS REFERENCE TO RELATED APPLICATIONS

This application is a continuation-in-part of U.S. patent application Ser. No. 10/692,341, filed Oct. 23, 2003.

STATEMENT REGARDING FEDERALLY SPONSORED RESEARCH OR DEVELOPMENT

Not Applicable

BACKGROUND OF THE INVENTION

The present invention pertains to grill brushes for cleaning grill grates such as the grates of gas fired barbecue grills and a cleaning system employing a grate and grill brush specially configured for use therewith.

The use of brushes and scrapers for the cleaning of grill grates of gas grills is well known. Typically, grill brushes have a head portion and a handle portion. Grill brushes known in the art typically have metallic bristles, which are generally all of a constant length and form a generally planar abrasive surface. This bristle configuration permits the top surface of the grill to be scrubbed with the grill brush but does not facilitate the cleaning of the sides of the grill grate bars. With known grill brushes it is therefore difficult to remove accumulated deposits from the sides of the grate bars without significant effort.

It would therefore be desirable to have a grill brush that more effectively removes deposits and grease from the sides of the grate bars of a grill grate while also removing deposits from the top surface of the grate.

BRIEF SUMMARY OF THE INVENTION

In accordance with the present invention an improved grill brush is disclosed. The brush has a head portion and a handle portion. Metallic bristles are mounted in and extend from a surface of the head portion. In one embodiment the bristles are arranged in generally parallel rows that extend from a surface of the head portion by first and second heights, wherein the second height is less than the first height. When the bristles of the grill brush are urged against the grill grate for the purpose of cleaning the grate, the longer bristles extend into the openings between parallel spaced grill grate bars and scrub the sides of the grate bars while the shorter bristles scrub the top surface of the bars of the grill grate. The widths of the rows of shorter bristles may be selected to correspond generally to the widths of the grill grate bars with which the grill brush is intended to be used. Similarly, the widths of the rows of longer bristles may be specified to correspond to the spacings between the grill grate bars. The specific widths of the rows of the shorter bristles and the longer bristles may be specified to provide effective cleaning of different grill grate designs.

In another embodiment of the invention, the contour of the top surface of the bristles is specified to correspond to the contour formed by the grate to promote effective scrubbing and removal of deposits from the top surface and accessible side surfaces of the grate.

Other features and advantages of the presently disclosed grill brush and grill cleaning system will be apparent to those of ordinary skill in the art from the Detailed Description of the Invention that follows.

BRIEF DESCRIPTION OF THE SEVERAL VIEWS OF THE DRAWINGS

The invention will be more fully understood by reference to the following Detailed Description of the Invention in conjunction with the Drawings of which.

DETAILED DESCRIPTION OF THE INVENTION

This application is a continuation-in-part of U.S. patent application Ser. No. 10/692,341, filed Oct. 23, 2003, the contents; of which are hereby incorporated by reference herein.

In accordance with the present invention an improved grill brush and a grill brush cleaning system is disclosed. The presently disclosed grill brush and cleaning system provides for more effective removal of deposits and grease that accumulate during use on the grates of grills, such as gas barbecue grills.

Figure 1A:
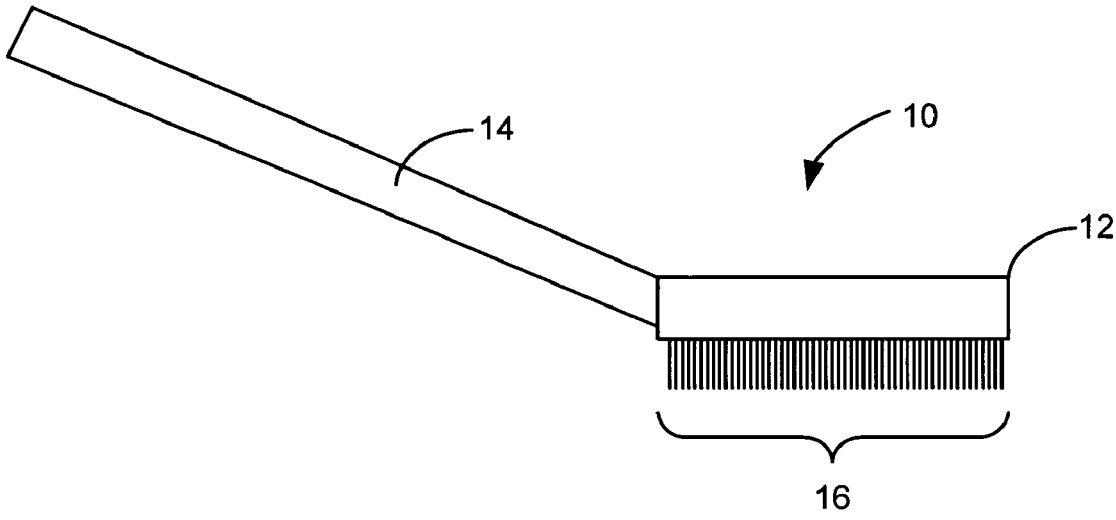
Fig. 1a Prior Art
FIG. 1*a* is a side view of a prior art grill brush.
Figure 1B:
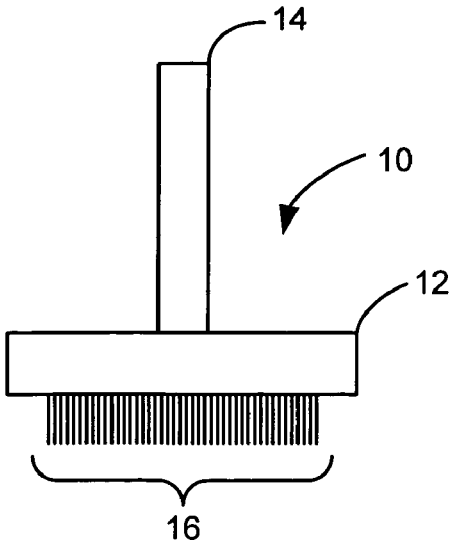
Fig. 1b Prior Art
FIG. 1*b* is a front view of the prior art grill brush of FIG. 1*a;*

A prior art grill brush is depicted schematically in FIGS. 1*a* and 1*b*. Referring to FIGS. 1*a* and 1*b*, the grill brush 10 includes a head portion 12 a handle portion 14 and a plurality of metallic bristles 16 mounted to the head portion 12. The handle portion 14 may include a thermoplastic or rubber covering (not shown) for added comfort. In one embodiment, the handle portion 14 is angled between 120–160 degrees with respect to the head portion 12. As illustrated in FIGS. 1*a* and 1*b*, the metallic bristles 16 are of a generally constant length and the ends of the bristles form a cleaning surface that is generally planar. Known prior art grill brushes typically are fabricated of wood or plastic.

Figure 2A:
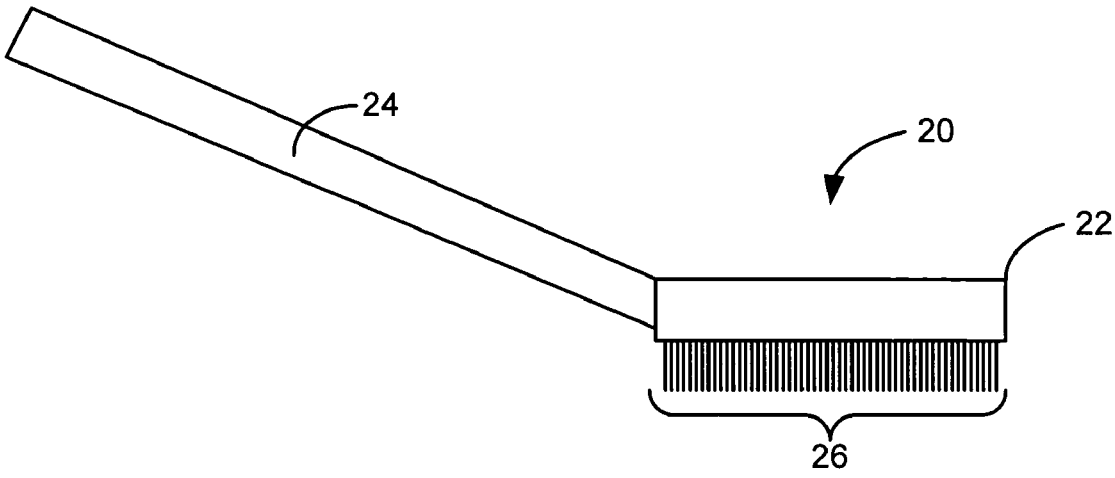
FIG. 2*a* is a side view of an exemplary grill brush in accordance with the present invention.
Figure 2B:
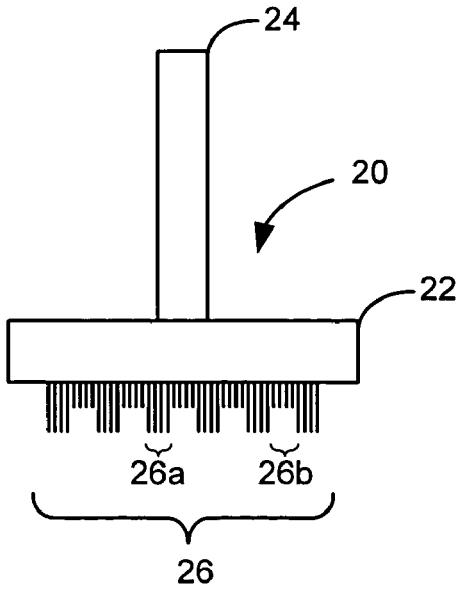
FIG. 2*b* is a front view of the grill brush of FIG. 2*a;*

Referring to FIGS. 2*a* and 2*b*, a grill brush in accordance with the present invention is shown. The grill brush 20 includes a head portion 22, a handle portion 24 and metallic bristles 26 that are mounted within the head portion and extend from the bottom surface thereof. As illustrated in FIG. 2*b*, the metallic bristles 26 are arranged in generally parallel rows having first and second different heights. More specifically, the metallic bristles 26 include longer bristles 26*a* which are intended to extend between the spaces formed between adjacent parallel grate bars and shorter bristles 26*b* which are intended to scrape and clean the top surface of the grill grate.

Figure 3A:
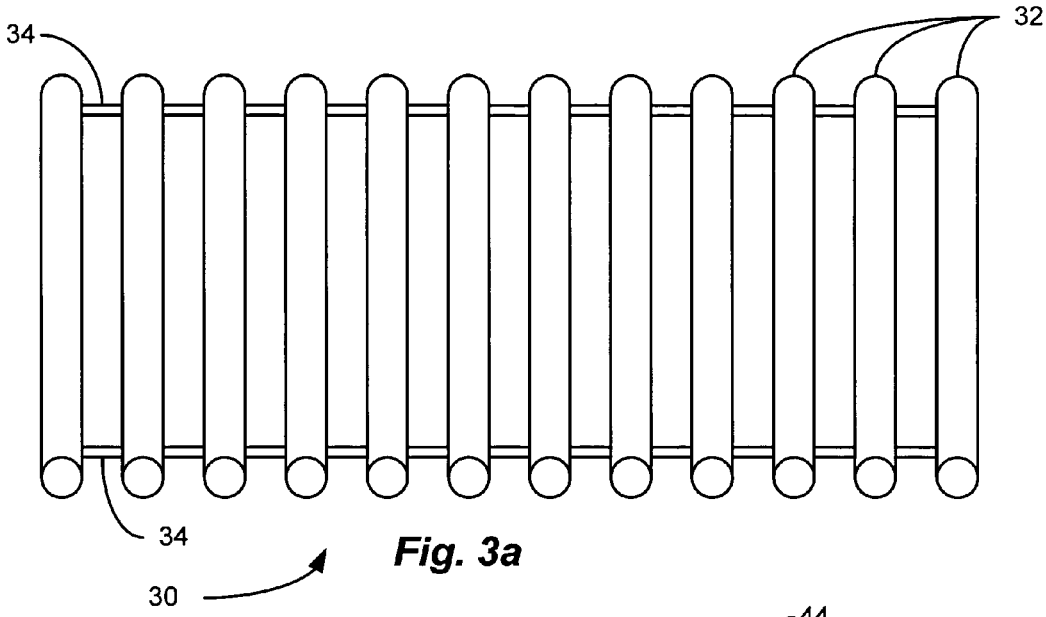
FIG. 3*a* is a perspective view of a grill grate employing round grate bars for use in a cleaning system with the grill brush depicted in FIGS. 2*a* and 2*b;*

Grill grates are provided in various forms. One conventional grill grate 30 includes generally circular rods 32 maintained in position by welded cross members 34 as illustrated in FIG. 3*a*. Additionally, another conventional grill grate 40, has grate bars 42 formed with a generally planar top surface 44 and angled side surfaces 46. The grate bars 40 are maintained in position by welded cross members 48.

Figure 4A:
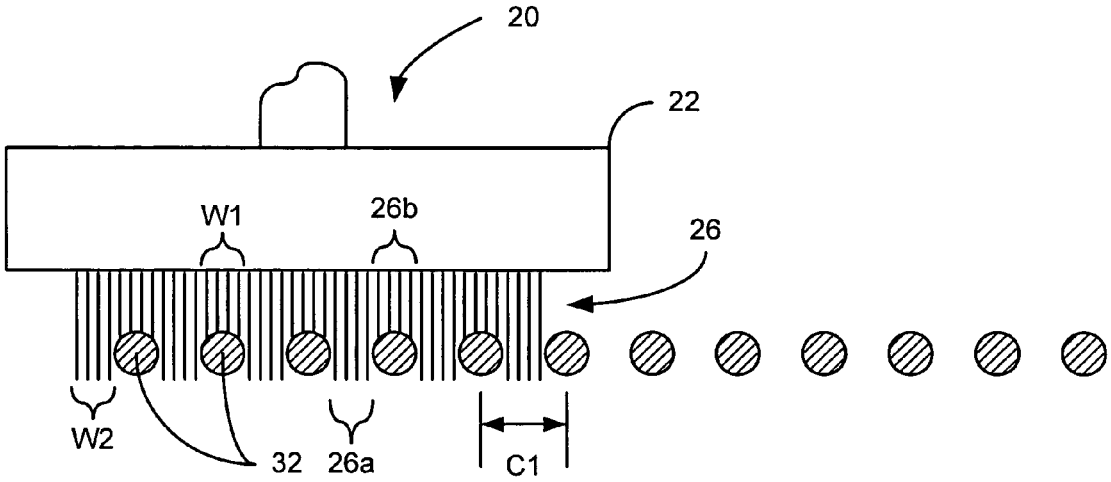
FIG. 4*a* is a partial front view of the grill brush of FIGS. 2*a* and 2*b* with the grill grate of FIG. 3*a* shown in cross section and depicting the grill brush in a scrubbing position with respect to the grill grate.
Figure 4B:
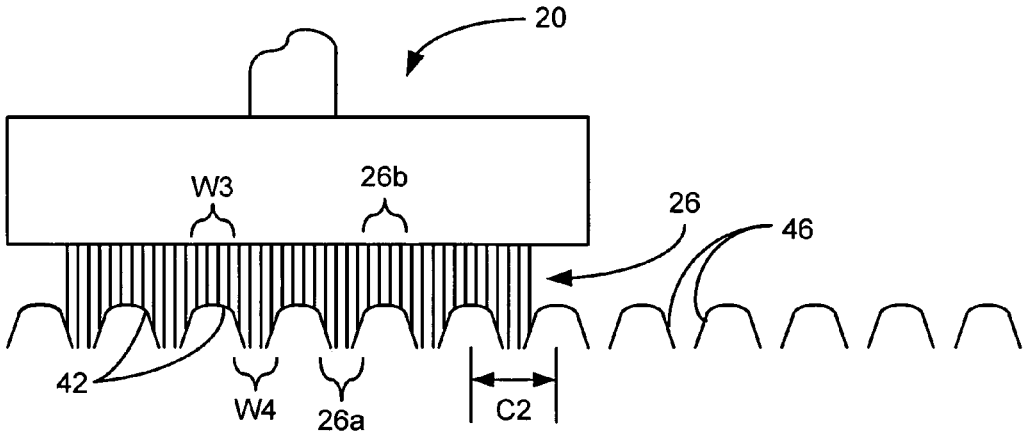
FIG. 4*b* is a partial front view of the grill brush of FIGS. 2*a* and 2*b* with the grill grate of FIG. 3*b* shown in cross section and depicting the grill brush in a scrubbing position with respect to the grill grate.

The use of the presently disclosed grill brush for the cleaning of grill grates is illustrated in FIGS. 4*a* and 4*b*. More specifically, the grill brush 20 is positioned over the circular rods 32 such that the rods 32 are urged into the recesses formed between the rows of different height bristles 26. The bristles 26 of the grill brush 20 may then be urged against the circular rods 32 while the grill brush is moved back-and-forth along the length of the circular rods to clean the rods 32 and remove deposits therefrom. The shorter bristles 26*b* are formed in generally parallel rows of a specified width W1 and deform to provide scrubbing of the curved upper surface of the circular rods 32. The longer bristles 26*a* are provided in rows of width W2 and are generally parallel to the other rows of bristles. The longer bristles 26*a* extend between the openings formed by the parallel circular rods 32 located generally on spaced centerlines C1 so as to provide more effective scrubbing of the sides of the rods 32 than is readily achieved using conventional grill brushes. It should be appreciated that the disclosed brush may be used with grill grates having centerlines corresponding to the centerlines between shorter bristle 26*b* rows or with grates having different centerline spacings.

Figure 3B:
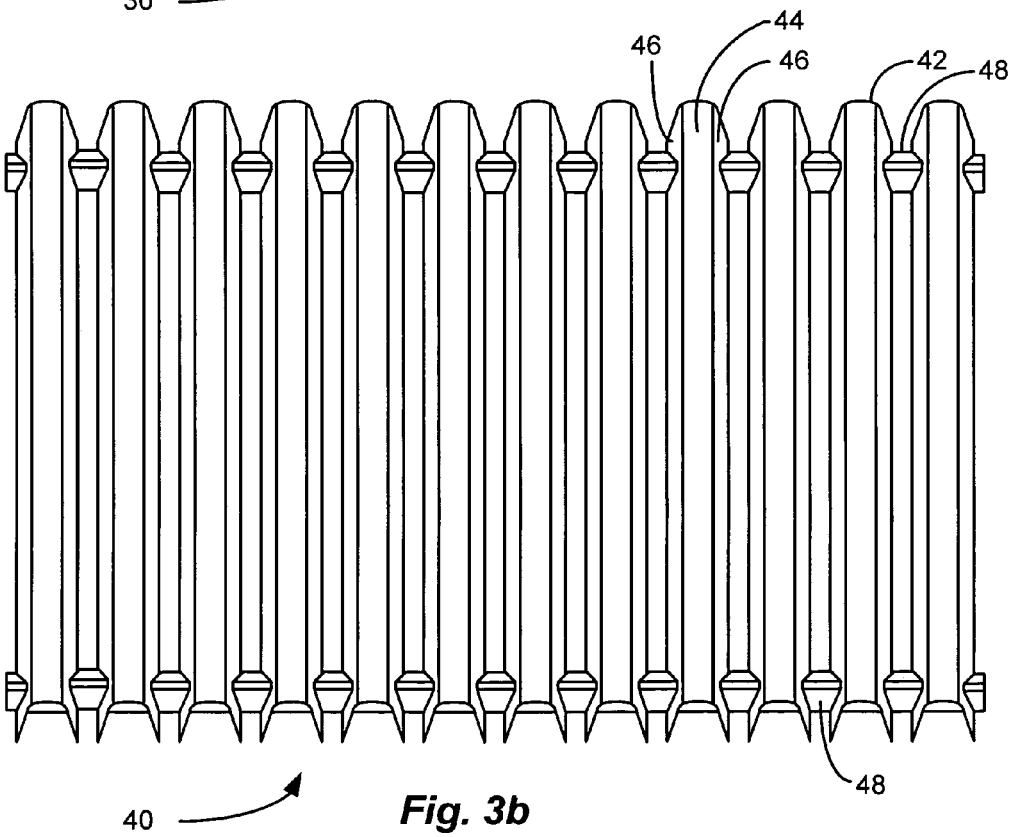
FIG. 3*b* is a perspective view of a grill grate including grate bars having a generally planar supporting surface and angled side surfaces for use in a cleaning system with the grill brush depicted in FIGS. 2*a* and 2*b;*

Similarly, referring to FIG. 4*b*, the presently disclosed grill brush 20 may be employed to effectively clean a grill grate of a type depicted in FIG. 3*b* with grates spaced on centerlines C2. Referring to FIG. 4*b*, the grill brush 20 is disposed over the grate bars 42 with the rows of longer bristles 26*a* having a width W4 such that the longer bristles deform and extending into the openings formed between the grate bars 42. The shorter bristles 26*b* are arranged in rows of width W3 so as to provide effective cleaning of the top surface of the grate bars 42. It will be appreciated that the bristles 26 will deform when urged against the grate bars 42. As indicated above, the bristles 26 of the grill brush 20 may be urged against the grate bars while the grill brush 20 is moved back-and-forth along at least a portion of the length of the grate bars 42 to clean the grate bars 42 and remove deposits therefrom.

In an improved cleaning system, the grill brush and the grate are especially adapted for use with one another. More specifically, referring to FIGS. 4*a* and 4*b*, the short rows or short bristles 26*b* may be spaced on centerlines that correspond to the centerlines of the circular rods 32 or the grate bars 42 and may have a width specified so as to generally conform to the top surface of the respective grate. In the case of the circular rods 32 the width of the short bristle rows may be slightly less than the diameter of the circular rods 32 so that cleaning of the rods 32 will be achieved with deformation of the bristles 26 when urged into contact with the rods 32. Similarly, referring to FIG. 4*b*, the width of the short rows of bristles 26*b* may be specified so as to generally correspond to the width of the top surface 44 of the grate bars 42. The widths of the rows of the longer bristles 26*a* may be specified to generally correspond to the width of the spacing between the top surfaces 44 of the grate bars 42. The longer bristles 26*a* will thus deform when urged into the openings between the grate bars 42 and effectively scrape deposits from the sides 46 of the respective grate bars 42.

Figure 5:
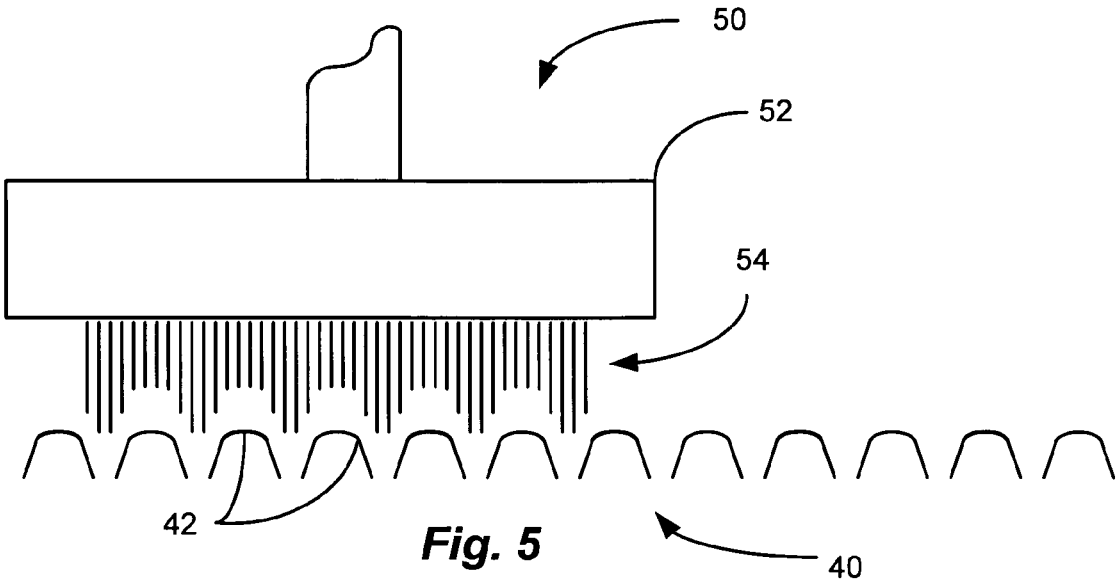
FIG. 5 is a partial front view of another embodiment of a grill brush in accordance with the present invention in which the ends of the bristles define a contoured non-planar cross section that generally corresponds to the contour of a grill grate with which the grill brush is intended to be used.

In another embodiment of the invention illustrated in FIG. 5, the contour of the bristles in cross-section is specified to generally correspond to the contour of the cross-section of the grate to be cleaned. More specifically, referring to FIG. 5 a cross-section of a grill brush 50 is shown positioned above a grate of the type depicted in FIG. 3*b*. The grill brush 50 includes a head portion 52 with bristles 54 mounted in and extending from the head portion 52. The bristles 54 have a contour that generally corresponds to the cross-section of the grate contour so that the bristles 54 conform to the grate contour when urged into contact therewith to provide effective scrubbing of the top and side surfaces of the grate bars.

The bristles in the grill brushes herein described may be fabricated of a metallic material such as brass, copper or stainless steel. Given that grill brushes are often used outdoors, it is preferable that the bristles be fabricated of a material that will not rust such as brass, copper or stainless steel. While the illustrated embodiment is described in terms of the use of metallic bristles, it should be appreciated that any bristles that are suitably stiff and resilient may be employed, including non-metallic bristles. For example, bristles of several materials can be combined in a grill brush.

All the bristles of a grill brush can have the same stiffness. Alternatively, some of the bristles can be stiffer than other bristles. Many techniques can be used to make one type of bristle stiffer than another type of bristle. For example, the stiffer bristles can be thicker (i.e. larger in cross-sectional diameter) or have a different cross-sectional shape than the more flexible bristles. Other mechanical modifications can also be used to stiffen bristles. For example, stiff bristles can be crimped along their lengths, and flexible bristles can remain uncrimped. Alternatively, stiff bristles can have more crimping than flexible bristles.

All the bristles of the grill brush can be made of a single material, such as stainless steel. Alternatively, the stiff bristles can be made of a different material than the more flexible bristles. For example, a grill brush can include a combination of bristles made of a relatively flexible material, such as brass or copper, and bristles made of a relatively stiff material, such as stainless steel. In addition, combinations of relatively stiff material and stiffening characteristics (such as the above-noted bristle thickness) can be used for the stiff bristles.

The relatively flexible bristles can be arranged in rows parallel to rows of relatively stiff bristles. In one embodiment, the relatively flexible bristles are longer than the relatively stiff bristles. In another embodiment, the relatively flexible bristles are the same lengths as the relatively stiff bristles.

Thus, the brush can be made of at least two types of bristles, where type can be defined in terms of stiffness, length, thickness, material or other characteristic or combinations thereof.

Figure 9:
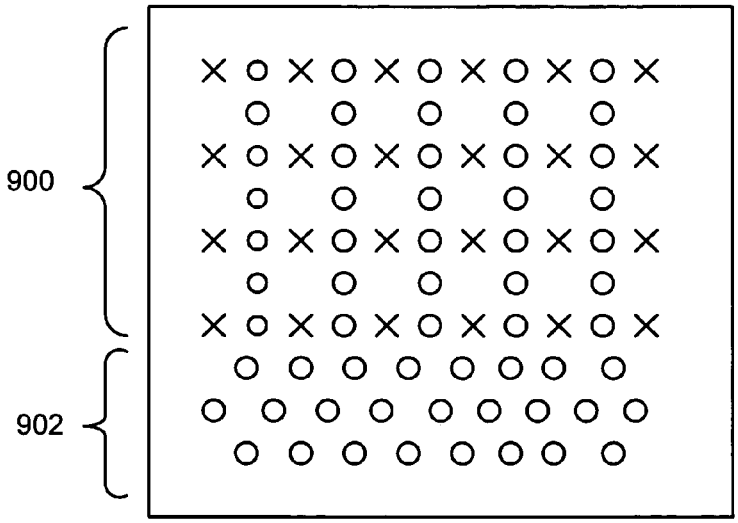
FIG. 9 is a partial bottom view of the grill brush in accordance with one embodiment of the present invention and depicting a pattern of two types of bristles.

A group of one or more rows of relatively flexible bristles can be arranged adjacent and parallel to a group of one or more rows of relatively stiff bristles. The groups of rows of relatively flexible bristles can alternate with the groups of rows of relatively stiff bristles. For example, the bristles can be arranged as shown in FIG. 9, in which each tuft of stiff bristles is indicated by an "o" and each tuft of flexible bristles is indicated by an "x." In the embodiment shown in FIG. 9, a first section of bristles 900 includes alternating groups of relatively flexible and relatively stiff bristle rows, and a second section 902 includes all relatively stiff bristles. The second section 902 of bristles is located closer to the handle 24 than the first section 900 of bristles.

The relatively stiff bristle rows can be sized and spaced apart to correspond to the widths and positions of the circular rods 32 (FIG. 3*a*) or the grate bars 42 (FIG. 3*b*). Similarly, the relatively flexible bristle rows can be sized and spaced apart to correspond to the widths and positions of channels defined between adjacent pairs of the circular rods 32 or grate bars 42.

In use, the relatively flexible bristles can deform and extend into the channels defined between circular rods 32 or the grate bars 42, while the relatively stiff bristles scrub the top surfaces 44 of the circular rods or grate bars without necessarily deforming. In this case, the relatively flexible bristles act as "trackers" to follow the channels and thus maintain the relatively stiff bristles on top of the circular rods or grate bars.

As noted, in one embodiment, the relatively flexible bristles are longer than the relatively stiff bristles, and the rows are oriented parallel to a direction of intended use. For example, the long bristles 26*a* shown in FIG. 4*a* can be relatively flexible, and the short bristles 26*b* can be relatively stiff.

All rows need not be the same length nor contain the same number of tufts of bristles. Furthermore, it is not necessary for the rows of short and/or relatively stiff bristle rows to be as long as the rows of long and/or relatively flexible bristle rows.

The body of the grill brush may be fabricated as an integral structure of wood or plastic or any other suitable material. Alternatively, the handle may be fabricated separately from the head portion of the grill brush and may be mounted thereto.

Figure 6:
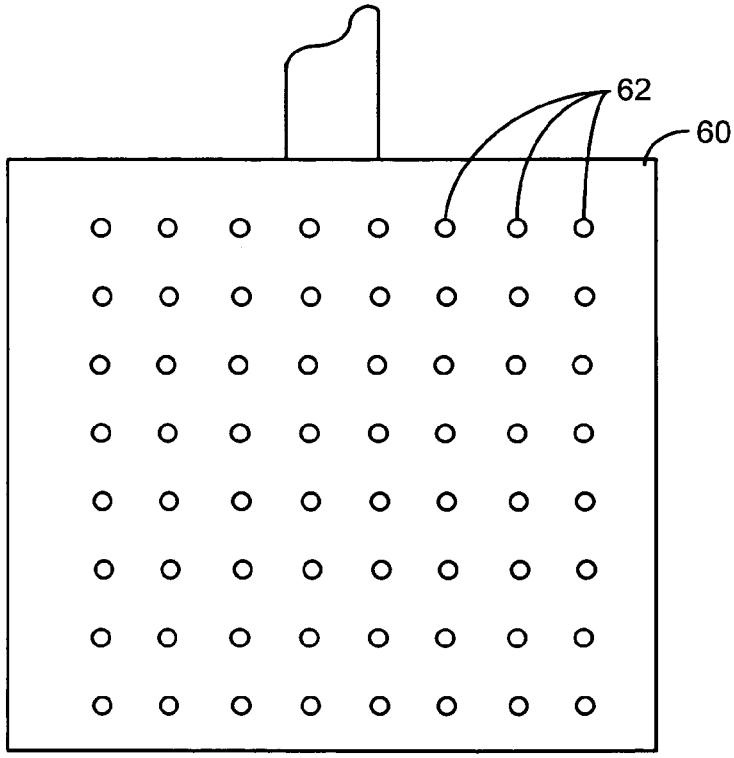
FIG. 6 is a partial bottom view of a grill brush in accordance with the present invention depicting recesses within the head portion of the grill brush of FIGS. 2*a* and 2*b* sized to receive clusters of bristles.
Figure 7:
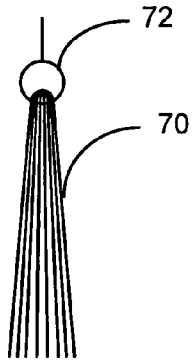
FIG. 7 is a side view of a bristle cluster assembly for mounting within the recesses depicted in FIG. 6.

The bristles may be mounted in a head portion 60 of a grill brush in preformed recesses 62 depicted in FIG. 6, or alternatively, the bristles may be secured within a molded head portion via an insert molding process. More specifically, in one known process used for the mounting of bristles in grill brushes, U-shaped bristles 70 are passed through an eye member 72 (see FIG. 7) and the eye member 72 is forced into a preformed recess 62 within the head portion 60 to securely retain the bristles within the head portion 62 as a plurality of tufts of bristles. The lengths of the U-shaped bristles in the presently disclosed invention are specified so as to provide the desired non-planar contour of the bristle surface to achieve effective cleaning of a grill grate. Thus, the bristles depicted schematically in FIGS. 2, 4 and 5 may comprise tufts of bristles that have ends, which provide a surface having the above-described grill cleaning profiles. Additionally, while FIG. 7 depicts an eye member 72 that is used to secure the u-shaped bristles within the recesses 62 of the head portion 60, the u-shaped bristles may be secured within the head portion 60 with any curved or straight retaining member which is sized to be press fit into a recess 62 after insertion of the u-shaped bristles to captively retain the bristles within the head portion 60. The retaining member may be metallic or any other suitable material.

Figure 8:
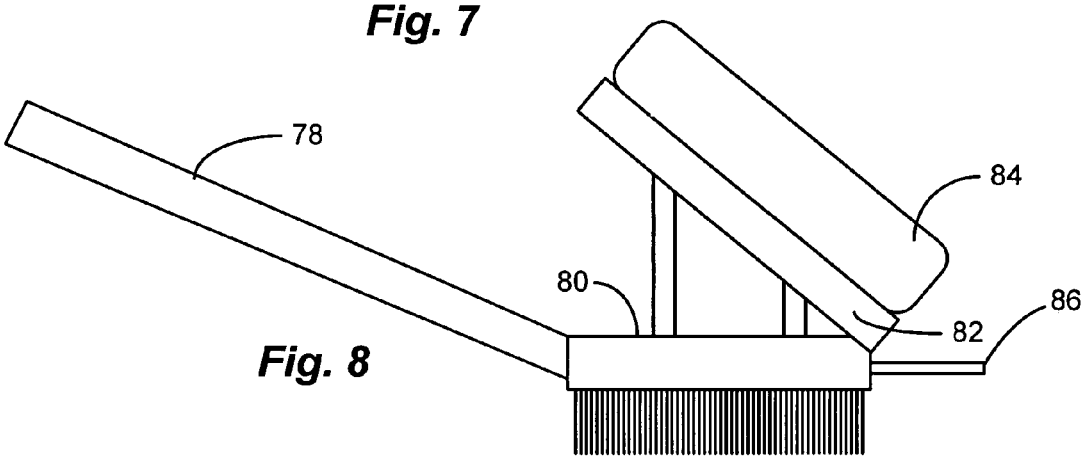
FIG. 8 is a side view of a grill brush in accordance with the present invention that further includes a support member, an abrasive pad mounted to the support member and a metallic scraper extending from the head portion.

As illustrated in FIG. 8, a head portion 80 may include an additional support member 82 having an abrasive pad 84 mounted thereto. Moreover, the head portion 80 of a grill brush in accordance with the present invention may have a metallic scraper 86 mounted to the front of the head portion 80 opposite the handle 78 to permit more aggressive scraping of deposits on the surfaces of a grill grate. It should be appreciated that an abrasive pad 84 and a scraper 86 may be included with any of the embodiments herein disclosed.

Though the handle 78 is shown in FIG. 8 as extending from the head portion 80 in the illustrated embodiments, it should be appreciated that the grill brush may be fabricated such that the handle 78 extends from or is coupled to the abrasive pad supporting member 82 or the supporting structure between the head portion 80 and the abrasive pad supporting member 82. In one embodiment, the handle 78 position is configured so as to form an angle between a plane passing generally through the ends of the bristles and a line passing generally longitudinally through the handle and additionally, to form an angle between a plane passing generally through the exposed surface of the abrasive pad and the line passing generally longitudinally through the handle to facilitate ease of use of the grill brush when employing either the bristles or the abrasive pad for grill cleaning.

It will further be apparent to those of ordinary skill in the art that that variations of and modifications to the above described grill brush and grill cleaning system may be made without departing from the inventive concepts disclosed herein. Accordingly, the invention should not be viewed as limited except by the scope and spirit of the appended claims.

What is claimed is:

1. A grill brush for cleaning generally parallel spaced grate bars of a grill, wherein said grate bars have a top surface, side surfaces and a length and form a grate surface contour along a cross-section in a plane orthogonal to said length, said grill brush comprising:

a handle portion;

a head portion extending from said handle portion, said head portion having a first surface; and a plurality of deformable metallic bristles mounted to said head portion and extending from said first surface of said head portion, wherein said plurality of deformable metallic bristles comprises:

a first plurality of deformable metallic bristles having a first stiffness; and a second plurality of deformable metallic bristles having a second stiffness greater than said first stiffness;

said plurality of metallic bristles including first and second sections displaced from one another in a direction of intended brush travel during use, said first and second sections each extending substantially a full width of the brush and said first and second sections being generally of the same width in a direction transverse to said direction of intended brush travel;

said first section comprises bristles of said first stiffness and bristles of said second stiffness; and said second section comprises bristles of said second stiffness and no bristles of said first stiffness.

2. The grill brush of claim 1, wherein said head portion includes a rearward portion adjacent said handle and a forward portion more distal from said handle than said rearward portion;

said first section is located on said forward portion of said head portion; and said second section is located on said rearward portion of said head portion.

3. A grill brush for cleaning generally parallel spaced grate bars of a grill grate, wherein said grate bars have a top surface, side surfaces and a length and form a grate bar surface contour along a cross-section in a plane orthogonal to said length, said grill brush comprising:

a handle portion;

a head portion extending from said handle portion, said head portion having a first surface; and a plurality of deformable metallic bristles mounted to said head portion and extending from said first surface of said head portion, wherein said plurality of metallic bristles comprises:

a first plurality of deformable metallic bristles having a first length; and a second plurality of deformable metallic bristles, at least some of said second plurality of deformable metallic bristles having a second length shorter than said first length; and wherein:

said plurality of deformable metallic bristles including first and second sections displaced from one another in a direction of intended brush travel during use, said first and second sections extending substantially across a full width of the brush in a direction transverse to said direction of intended brush travel;

said first section comprises deformable metallic bristles of said first length and at least some deformable metallic bristles of said second length; and said second section comprises deformable metallic bristles of said second length and no bristles of said first length;

wherein said first section includes alternating rows of bristles of said first length and said second length and includes at least two rows of bristles of said first length and at least two rows of bristles of said second length, each of said rows extending generally in the direction of intended brush travel, said alternating rows in said first section extending substantially across the full width of said brush, and said second section includes bristles of said second length, but no bristles of said first length substantially across the full width of the brush.

4. The grill brush of claim 3, wherein said head portion includes a rearward portion proximate to said handle and a forward portion more distal from said handle, said first section is located on said forward portion of said head portion, and said second section is located on said rearward portion of said head portion.

5. The grill brush of claim 4, wherein at least a portion of said plurality of metallic bristles provides a non-planar bristle surface contour corresponding to at least a portion of the contour of said grate bars.

6. The grill brush of claim 3 wherein said first and second pluralities of bristles are arranged in pluralities of parallel alternating bristle rows and at least some of said bristle rows include plural rows of bristle tufts.

* * * * *